US008210484B2

(12) United States Patent
Doherty et al.

(10) Patent No.: US 8,210,484 B2
(45) Date of Patent: Jul. 3, 2012

(54) FIRE HOSE SAFETY ANCHOR AND METHOD

(75) Inventors: Denese Doherty, Carson City, NV (US); Ellis L. Aakre, Hawley, MN (US)

(73) Assignee: Rice Hydro, Inc., Carson City, NV (US)

( * ) Notice: Subject to any disclaimer, the term of this patent is extended or adjusted under 35 U.S.C. 154(b) by 1148 days.

(21) Appl. No.: 12/047,102

(22) Filed: Mar. 12, 2008

(65) Prior Publication Data

US 2008/0149784 A1 Jun. 26, 2008

Related U.S. Application Data

(63) Continuation-in-part of application No. 11/213,541, filed on Aug. 25, 2005, now Pat. No. 7,905,455.

(51) Int. Cl.
*B05B 15/00* (2006.01)

(52) U.S. Cl. ..... 248/89; 248/80; 248/68.1

(58) Field of Classification Search ..... 248/89, 248/90, 75, 80, 81, 65, 73; 211/60.1, 70
See application file for complete search history.

(56) References Cited

U.S. PATENT DOCUMENTS 3,819,137 A * 6/1974 Smith ..... 248/49
4,234,012 A 11/1980 Schupback
4,391,471 A 7/1983 Hauschopp et al.
4,715,570 A 12/1987 Mashuda
5,367,127 A 11/1994 Dormon
5,642,612 A 7/1997 Hughes et al.
5,829,243 A 11/1998 Hughes et al.
6,625,849 B1 9/2003 Womack et al.
6,752,360 B2 6/2004 Bennett
6,945,735 B1 * 9/2005 Doverspike ..... 405/184.4

* cited by examiner

*Primary Examiner* — Terrell McKinnon
*Assistant Examiner* — Steven Marsh
(74) *Attorney, Agent, or Firm* — Ian F. Burns & Associates, P.C.

(57) ABSTRACT

A fire hose safety anchor and securement system and method for efficiently and safely retaining multiple fire hoses during pressure testing is provided. The fire hose safety anchor and securement system includes a base member comprised of a base plate and a pair of attached mounting plates interconnected by a pair of retaining brackets and retaining pins. The base member is preferably secured to a floor surface by extending fasteners through a plurality of first anchor apertures. Hoses laid upon the base member are held in place by the retaining brackets. The retaining brackets may be slidably coupled to the base member. The base member may have at least one hose channel with separate retaining brackets for each hose channel allowing at least one hose to be removed from the system while pressure testing of the remaining hoses continues.

11 Claims, 10 Drawing Sheets

FIRE HOSE SAFETY ANCHOR AND METHOD

CROSS REFERENCE TO RELATED APPLICATIONS

The present application is a continuation-in-part of application Ser. No. 11/213,541, filed on Aug. 25, 2005, entitled "Fire Hose Safety Anchor And Securement System."

BACKGROUND OF THE INVENTION

1. Field of the Invention

The present invention relates generally to hose retaining devices and more specifically it relates to a fire hose safety anchor and securement system and method for efficiently and safely retaining multiple fire hoses during pressure testing.

2. Description of the Related Art

Any discussion of the prior art throughout the specification should in no way be considered as an admission that such prior art is widely known or forms part of common general knowledge in the field.

Hose retaining devices have been in use for years. Typically, hose holding devices consist of an apparatus having apertures or a mechanism for receiving a single hose, a garden hose for example. The device can loosely except a hose and secure it for the water pressure required for its particular purpose. Unfortunately, hose holders currently used today do not retain multiple hoses with large diameters (e.g. fire hoses) nor do they safely secure them at the water pressures required for fire hoses.

While these devices may be suitable for the particular purpose to which they address, they are not as suitable for efficiently and safely retaining multiple fire hoses during pressure testing. Current hose holding devices do not safely secure multiple large diameter hoses that utilize high water pressure.

In these respects, the fire hose safety anchor and securement system and method according to the present invention substantially departs from the conventional concepts and designs of the prior art, and in so doing provides an apparatus and process primarily developed for the purpose of efficiently and safely retaining multiple fire hoses during pressure testing.

BRIEF SUMMARY OF THE INVENTION

In view of the foregoing disadvantages inherent in the known types of hose retaining devices now present in the prior art, the present invention provides a new fire hose safety anchor and securement system construction wherein the same can be utilized for efficiently and safely retaining multiple fire hoses during pressure testing.

The general purpose of the present invention, which will be described subsequently in greater detail, is to provide a new fire hose safety anchor and securement system that has many of the advantages of the hose retaining devices mentioned heretofore and many novel features that result in a new fire hose safety anchor and securement system which is not anticipated, rendered obvious, suggested, or even implied by any of the prior art hose retaining devices, either alone or in any combination thereof.

To attain this, the present invention generally comprises a base member comprised of a base plate and a pair of attached mounting plates interconnected by a pair of retaining brackets and retaining pins. The base member is preferably secured to a floor surface by extending fasteners through a plurality of first anchor apertures. Hoses laid upon the base member are held in place by the retaining brackets. The retaining brackets are connected to the base member mounting plates by extending retaining pins through a mounting aperture in the mounting plates and a first aperture and a second aperture in the retaining brackets. The retaining brackets and the mounting plates may also be configured to slide onto and off of each other. This may be accomplished through the use of a receiving channel on retaining bracket adapted to receive a complimentary shaped protrusion of the mounting brackets. Alternatively, the ends of the mounting brackets may have the receiving channel and the bottom side of the bracket may have the protrusion. The mounting bracket may have holes through which the retaining bracket is slid. The anchor may also have at least one hose channel, each hose channel with its own closure mechanism, allowing a hose to be removed while others are being pressure tested or otherwise used. Each opening would be closed by a separate retaining bracket that may be attached with pins, bolt, hinges, and/or other means known to one of ordinary skill in the art.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary advantage of the present invention is to provide a fire hose safety anchor and securement system that will overcome the shortcomings of the prior art devices.

A second advantage is to provide a fire hose safety anchor and securement system for efficiently and safely retaining multiple fire hoses during pressure testing.

Another advantage is to provide a fire hose safety anchor and securement system that adjusts for varying hose diameters.

An additional advantage is to provide a fire hose safety anchor and securement system that is easily assembled for use.

A further advantage is to provide a fire hose safety anchor and securement system that meets the National Fire Protection Association code for fire hose testing equipment.

Still another advantage is to provide a fire hose safety anchor and securement system for safely and efficiently removing at least one fire hose during pressure testing while continuing to retain and pressure test the remaining hose or hoses.

Other advantages of the present invention will become obvious to the reader and it is intended that these advantages are within the scope of the present invention.

To the accomplishment of the above and related advantages, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
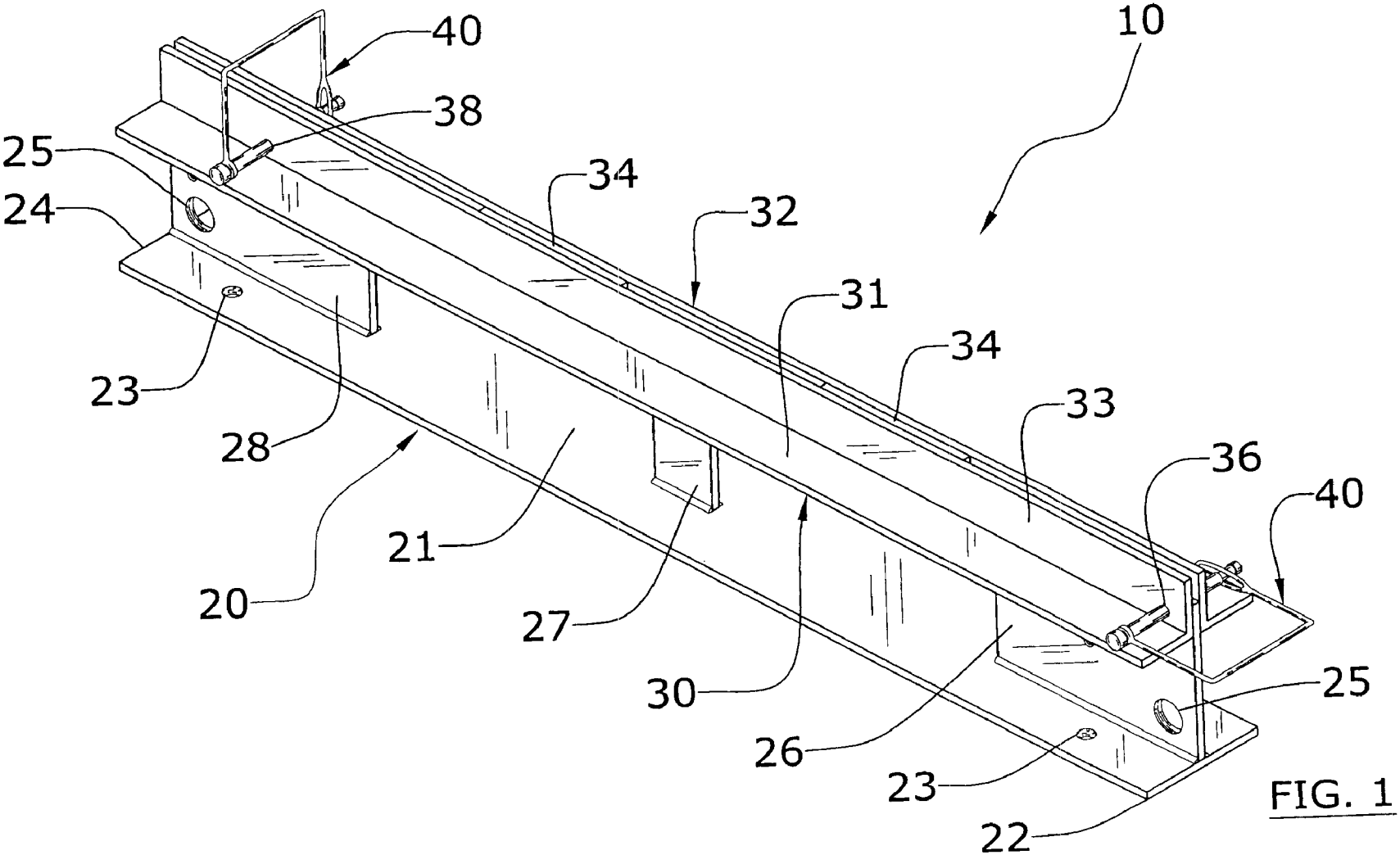
FIG. 1 is substantially an upper perspective view of the present invention.

In the following detailed description of the preferred embodiments, reference is made to the accompanying drawings which form a part thereof, and in which are shown by way of illustration specific embodiments in which the invention may be practiced. It is to be understood that other embodiments may be utilized and structural changes may be made without departing from the scope of the present invention.

A. Overview

Turning now descriptively to the drawings, in which similar reference characters denote similar elements throughout the several views, FIGS. 1 through 7 illustrate a fire hose safety anchor and securement system 10, which is comprised of a base member 20 including a base plate 21 and a pair of attached mounting plates 26, 28 interconnected by a pair of retaining brackets 30, 32 and retaining pins 40. As used herein, the term "securement" means the state of being secure, an act or instance of being secure, or the result of securing something. The base member 20 is preferably secured to a floor surface by extending fasteners through a plurality of first anchor apertures 23. Hose 12 laid upon the base member 20 are held in place by the retaining brackets 30, 32. The retaining brackets 30, 32 are connected to the base member 20 mounting plates 26, 28 by extending retaining pins 40 through a mounting aperture 29 in the mounting plates 26, 28 and a first aperture 36 and a second aperture 38 in the retaining brackets 30, 32.

B. Base Member

The base member 20 is comprised of a base plate 21, which may also include a first mounting plate 26, a second mounting plate 28, and a center plate 27. The base member 20 including any of its components 21, 26, 27, 28 are preferably made of rigid materials that will not significantly distort when welded to or while retaining hose 12 in the normal usage of the fire hose safety anchor and securement system 10. The base member 20 including any of its components 21, 26, 27, 28 are preferably made of a material which will withstand long periods of exposure to moisture without developing oxidation or corrosion. The base member 20 including any of its components 21, 26, 27, 28 may additionally be coated with a finishing material, such as paint, powder coating, etc., that adheres to the base member 20 components 21, 26, 27, 28 and is capable of withstanding long exposure to moisture.

In some embodiments, the base plate 21 is a substantially flat plate. In other embodiments, the base plate 21 is substantially flat except that it has at least one hose channel 47. In either case, the base plate 21 extends from a first end 22 to a second end 24 and is preferably constructed of a metal material (e.g. steel). As shown in FIGS. 1 through 7, towards the ends 22, 24 and outer perimeter of the base plate 21 is a plurality of first anchor apertures 23. The first anchor apertures 23 are used for extending fasteners through to retain the base member 20 to the floor or ground during usage of the fire hose safety anchor and securement system 10. The fasteners can permanently fix or allow for assembly and disassembly of the base member 20 and fire hose safety anchor and securement system 10.

The first mounting plate 26 and second mounting plate 28 are substantially flat plates preferably constructed of a metal material (e.g. steel). The mounting plates 26, 28 are attached to the base plate 21 preferably by welding, but it can be appreciated that other methods of attachment are possible. As shown in FIGS. 1 through 7, the first mounting plate 26 is positioned perpendicular to the base plate 21, optionally centered on a centerline extending from the first end 22 to the second end 24 of the base plate 21 and located at the first end 22 of the base plate 21. The second mounting plate 28 is positioned perpendicular to the base plate 21, and it may be centered on a centerline extending from the first end 22 to the second end 24 of the base plate 21 and located at the second end 24 of the base plate 21.

Figure 3:
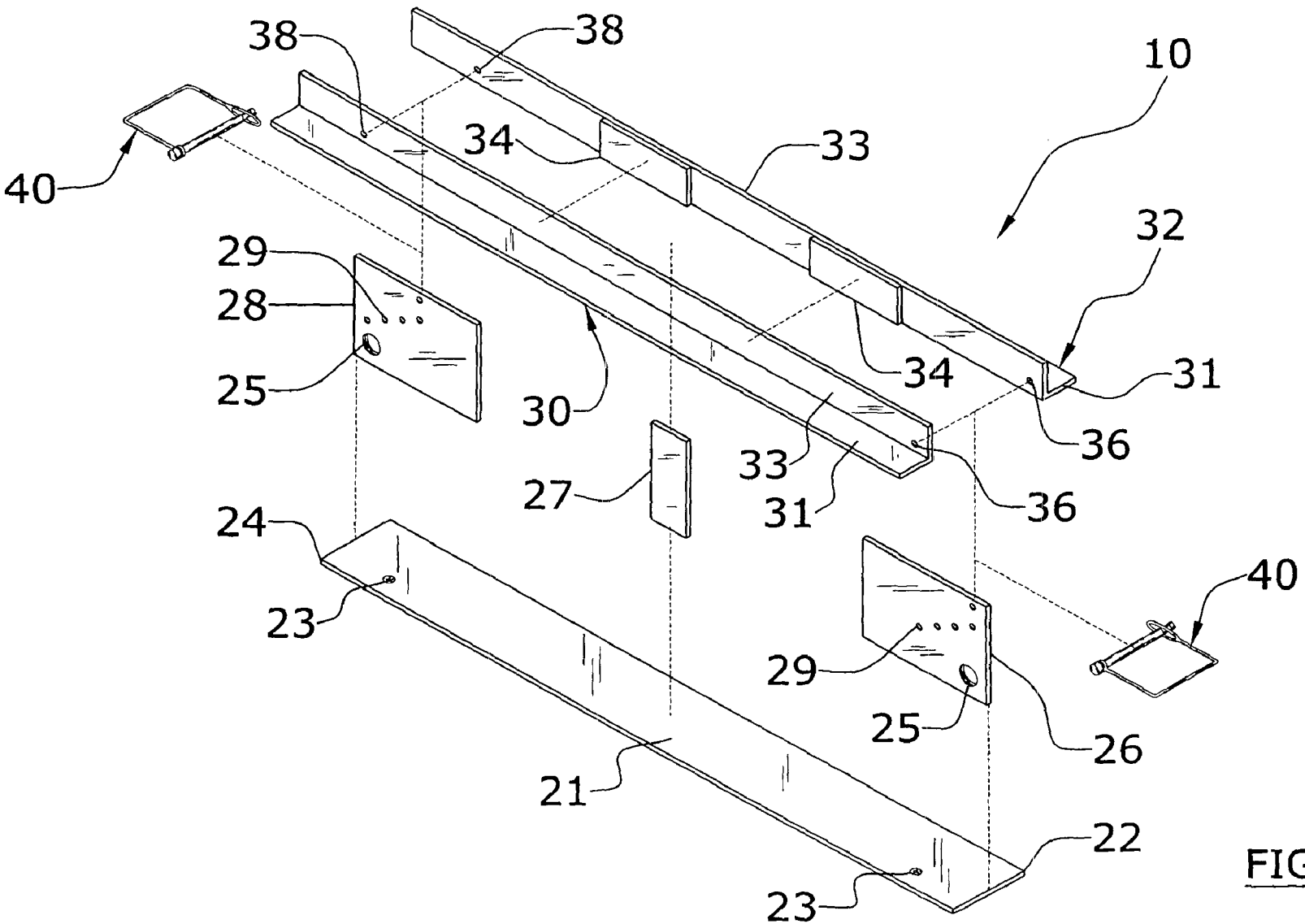
FIG. 3 is substantially an exploded upper perspective view of the present invention.
Figure 4:
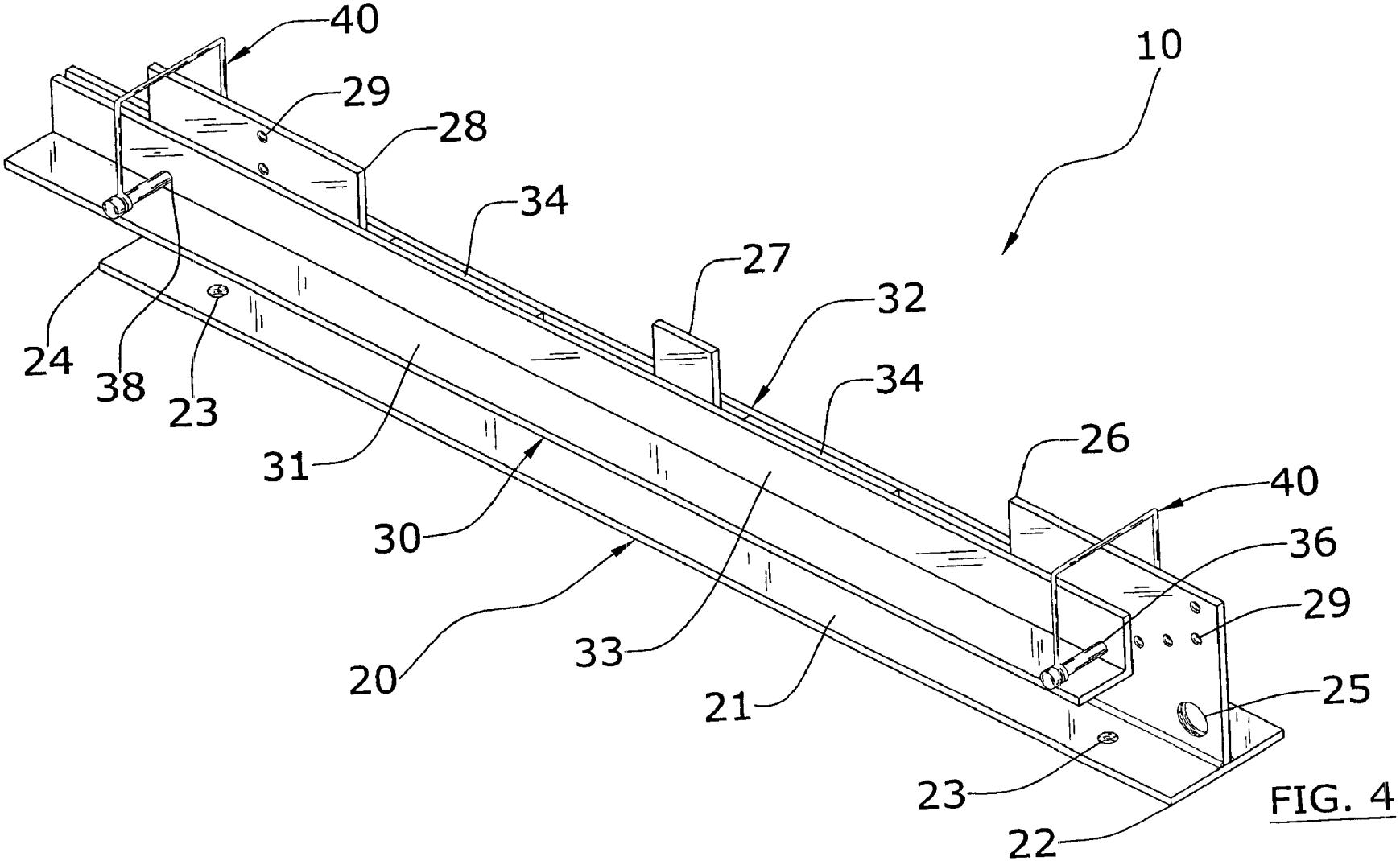
FIG. 4 is substantially an upper perspective view of the present invention showing an alternative configuration for smaller hose diameters.

Located in both the first mounting plate 26 and second mounting plate 28 is a pattern of mounting apertures 29. As best shown in FIG. 3, the pattern of mounting apertures 29 in each mounting plate 26, 28 are substantially identical and aligned to allow for the attachment of the first retaining bracket 30 and second retaining bracket 32. The mounting apertures 29 are sized to accept a retaining pin 40. The pattern of mounting apertures 29 in the mounting plates 26, 28 is designed to allow for the retaining brackets 30, 32 to be positioned parallel and at varying heights in relation to the base plate 21 to compensate for varying hose 12 diameters.

Also located in both the first mounting plate 26 and second mounting plate 28 is a second anchor aperture 25. As shown in FIGS. 1 through 7, the second anchor aperture 25 is sized larger than the first anchor aperture 23 located in the base plate 21 to allow for a rope or the like to extend through. This allows the base member 20 and fire hose safety anchor and securement system 10 to be fastened to other items such as a truck bed or pole.

The center plate 27 is a substantially flat plate preferably constructed of a metal material (e.g. steel). The center plate 27 is attached to the base plate 21 preferably by welding, but it can be appreciated that other methods of attachment are possible. As shown in FIGS. 1 through 7, the center plate 27 is positioned perpendicular to the base plate 21, aligned with the mounting plates 26, 28 and located a equal distance from each mounting plate 26, 28.

C. Retaining Pin

The retaining pins 40 are preferably made of a rigid material that will not significantly distort while retaining the first retaining bracket 30 and second retaining bracket 32 in the normal usage of the fire hose safety anchor and securement system 10. The retaining pins 40 are preferably made of a material which will withstand long periods of exposure to moisture without developing oxidation or corrosion. The retaining pins 40 are sized to securely fit within and extend through the apertures 36, 38 located in the retaining brackets 30, 32 and mounting apertures 29 in the mounting plates 26, 28.

D. Retaining Brackets

The first retaining bracket 30 and second retaining bracket 32 are preferably made of a rigid material that will not significantly distort when welded to or while retaining hose 12 in the normal usage of the fire hose safety anchor and securement system 10. The retaining brackets 30, 32 are preferably made of a material which will withstand long periods of exposure to moisture without substantially rusting. The retaining brackets 30, 32 may additionally be coated with a finishing material which must adhere to the retaining brackets 30, 32 and withstand long exposure to moisture. The retaining brackets 30, 32 are preferably constructed of structural angle material having a base 31 and a wall 33.

As shown in FIGS. 1 through 7, the retaining brackets 30, 32 extend substantially straight and are similar in length to the base plate 21. Located in the wall 33 at one end of the retaining brackets 30, 32 is a first aperture 36 and located towards the other end of the retaining brackets 30, 32 is a second aperture 38. The apertures 36, 38 are positioned and sized to allow a retaining pin 40 or the like to extend through and mount the retaining brackets 30, 32 to the mounting brackets 26, 28 on the base member 20.

Located on one of the retaining brackets 30, 32, preferably the second retaining bracket 32, are a pair of spacer plates 34. The spacer plates 34 are substantially flat plates preferably constructed of a metal material (e.g. steel) substantially the same thickness of the mounting plates 26, 28. The spacer plates 34 are preferably welded to the retaining brackets 30, 32, but other methods of attachment (e.g. fasteners) can be appreciated. As shown in FIGS. 1 through 7, the spacer plates 34 are positioned substantially adjacent to the wall 33 on either retaining bracket 30, 32, spaced an equal distance from the center of the desired retaining bracket 30, 32.

E. Operation of the Invention

In use, the fire hose safety anchor and securement system 10 is preferably utilized to secure hose 12 during water pressure testing of the hose 12. However, it can be appreciated that the fire hose safety anchor and securement system 10 could be used to water pressure test hose 12 used for other applications.

Initially to use the fire hose safety anchor and securement system 10, a location is found to place and secure the base member 20 such that the water sprayed from the hose 12 will not damage any objects or harm any users. The base member 20 is preferably secured to a floor surface by extending fasteners through the first anchor apertures 23 located in the base plate 21.

Figure 5:
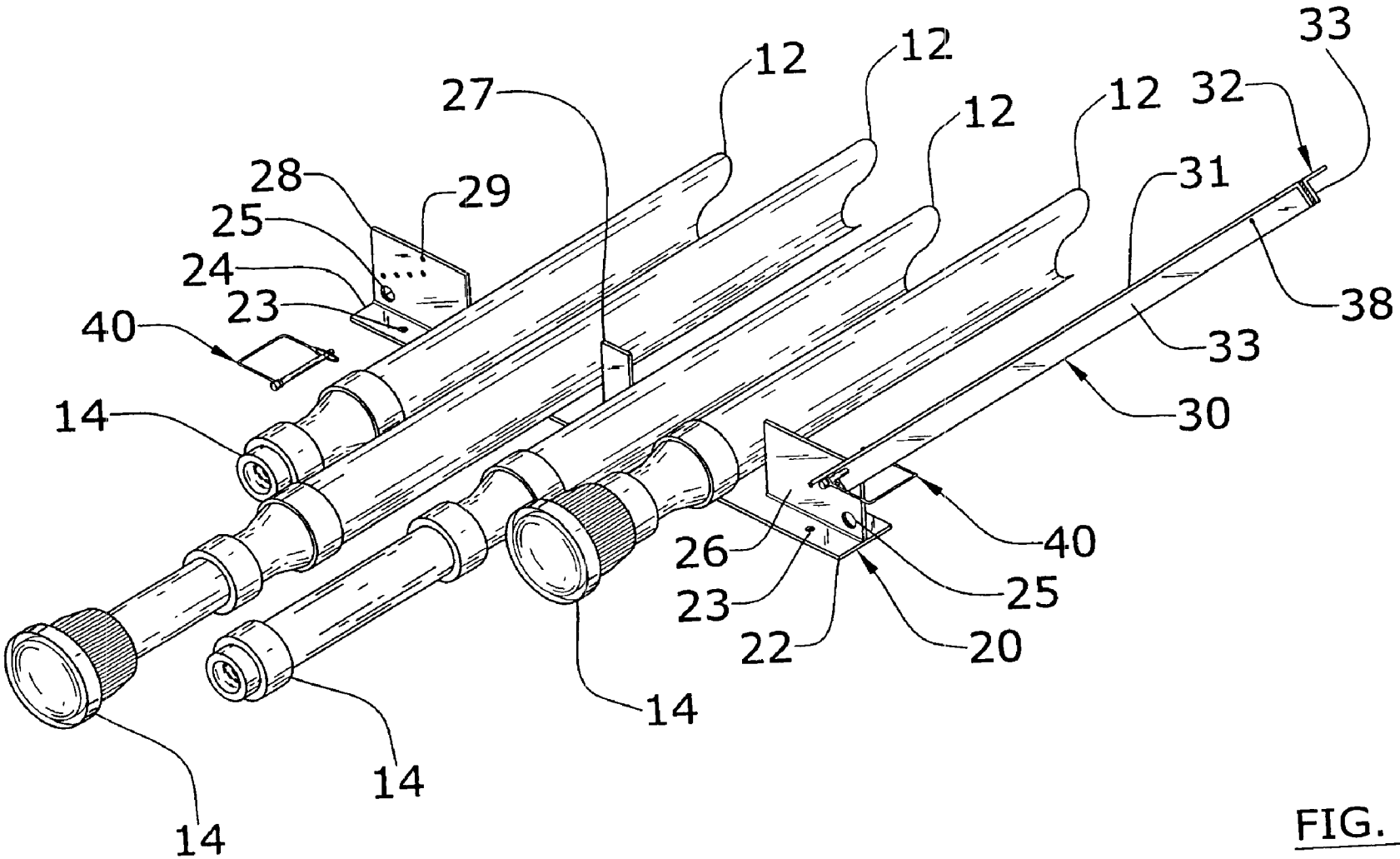
FIG. 5 is substantially an upper perspective view of the present invention with retaining brackets rotated and hoses in place.
Figure 6:
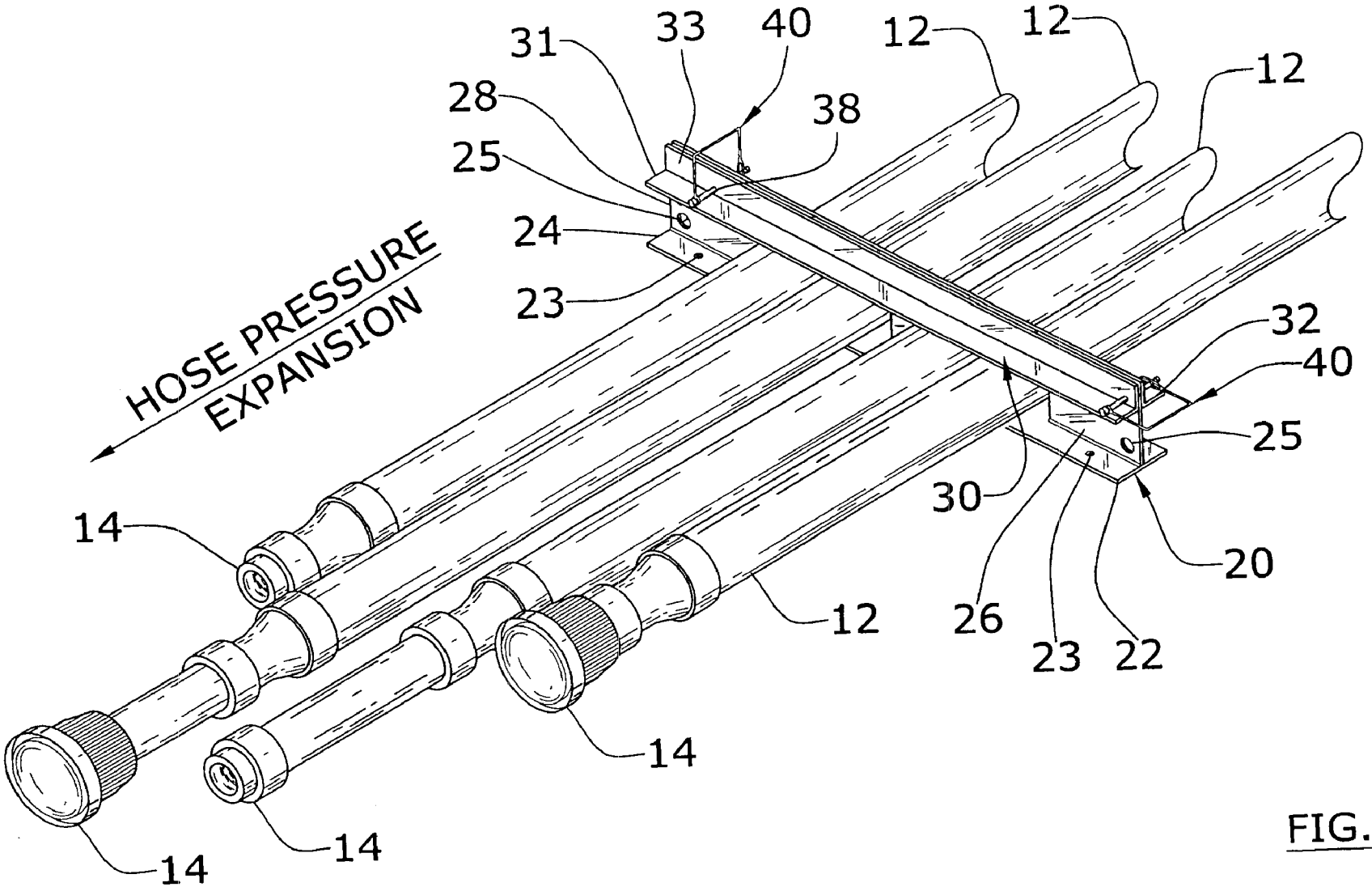
FIG. 6 is substantially an upper perspective view of the present invention with hoses retained and showing hose expansion from water pressure.

As best shown in FIG. 5, the hose 12 are laid upon the base plate 21 between the openings of the center plate 27 and mounting plates 26, 28. The hose 12 are positioned with the coupling 14 ends forward of the base plate 21 edge. As shown in FIG. 6, the first retaining bracket 30 and second retaining bracket 32 are then placed upon the hose 12 to determine which mounting apertures 29 in the mounting plates 26, 28 should be used to match the hose 12 diameter.

Figure 2:
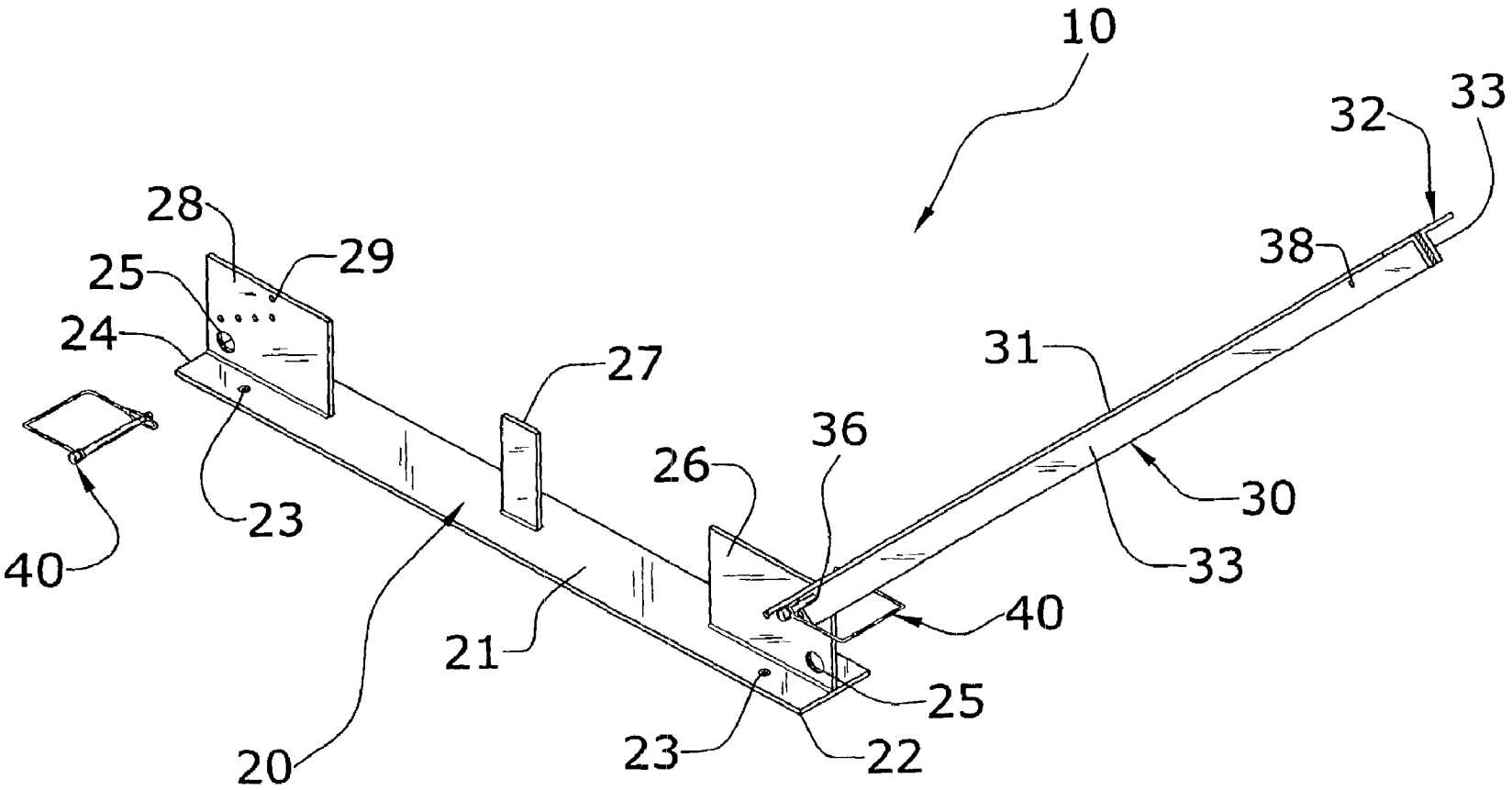
FIG. 2 is substantially an upper perspective view of the present invention with retaining brackets rotated.
Figure 7:
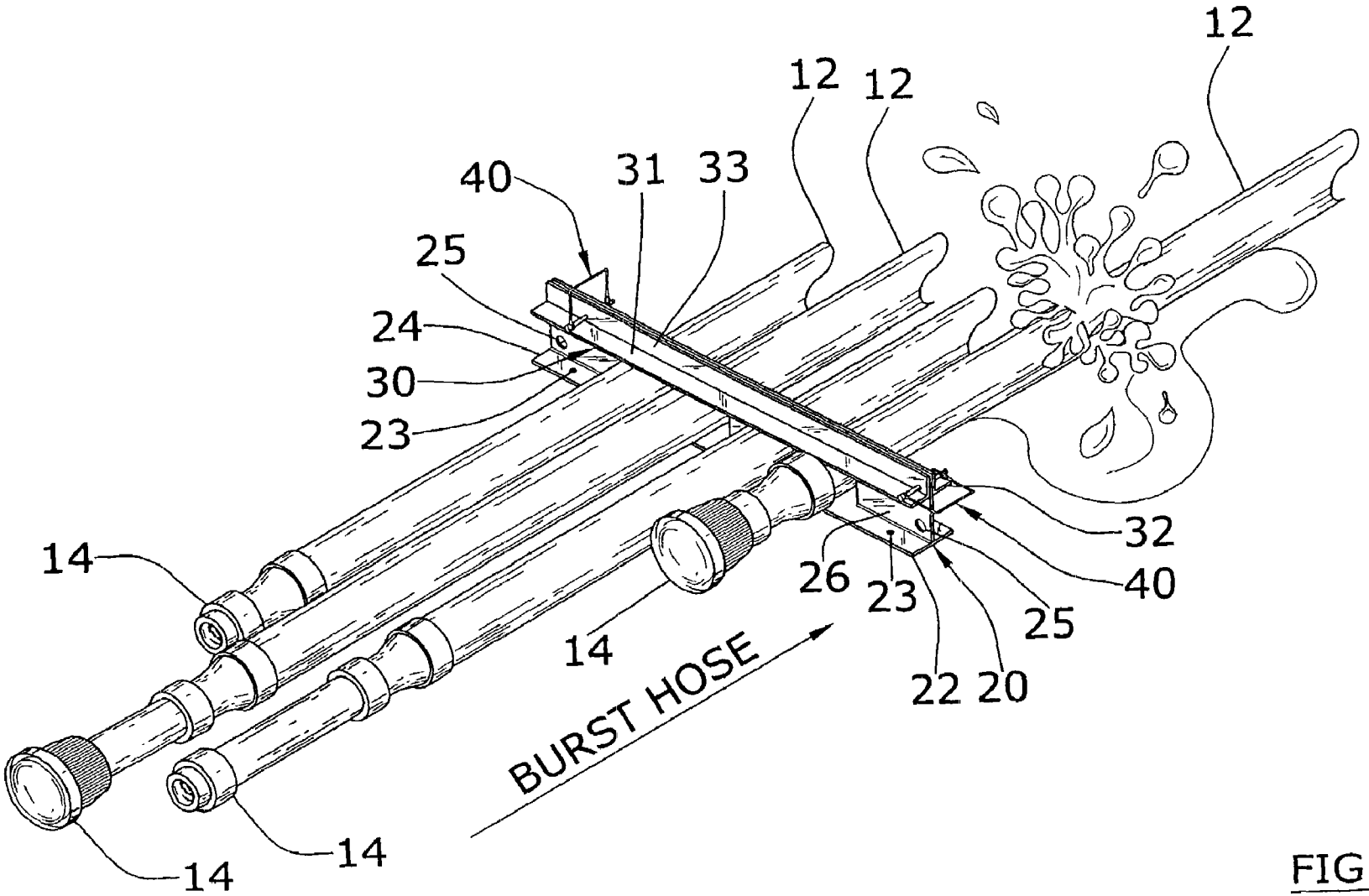
FIG. 7 is substantially an upper perspective view of the present invention showing a burst hose.

As best shown in FIGS. 2 and 5, once the appropriate mounting aperture 29 is determined, a first retaining pin 40 is extended through the first aperture 36 in the first retaining bracket 30 located on one side of the first mounting plate 26, through the pre-determined mounting aperture 29 in the first mounting plate 26 and through the first aperture 36 in the second retaining bracket 32 located on the other side of the first mounting plate 26. As best shown in FIGS. 6 and 7, the retaining brackets 30, 32 are pivoted about the first retaining pin 40 such that the base 31 of each retaining bracket 30, 32 lies tangent to the hoses 12 being retained and parallel to the base plate 31. A second retaining pin 40 is then extended through the second aperture 38 in the first retaining bracket 30 located on one side of the second mounting plate 28, through the pre-determined mounting aperture 29 in the second mounting plate 28 and through the second aperture 38 in the second retaining bracket 32 located on the other side of the second mounting plate 28. As shown in FIGS. 1 through 7, the spacer plates 34 preferably attached to the second retaining bracket 32 to provide additional support between the retaining brackets 30, 32.

As shown in FIG. 6, during the water pressure testing of the hoses 12, the coupling 14 ends extend away from the base member 20 and the fire hose safety anchor and securement system 10. The fire hose safety anchor and securement system 10 secures the hoses 12 during the pressure test, such that the hoses 12 ends are not able to move around uncontrollably and possibly injure someone. Furthermore, as shown in FIG. 7, if a hose were to burst during the water pressure test, the coupling 14 on that hoses 12 would only recoil back to the point at which the coupling 14 comes in contact with the first retaining bracket 30 and the base plate 31. As a result of the fire hose safety anchor and securement system 10, recoiling hoses 12 is stopped from potentially injuring someone or damaging any objects.

F. Slide-On Embodiment

Figure 8:
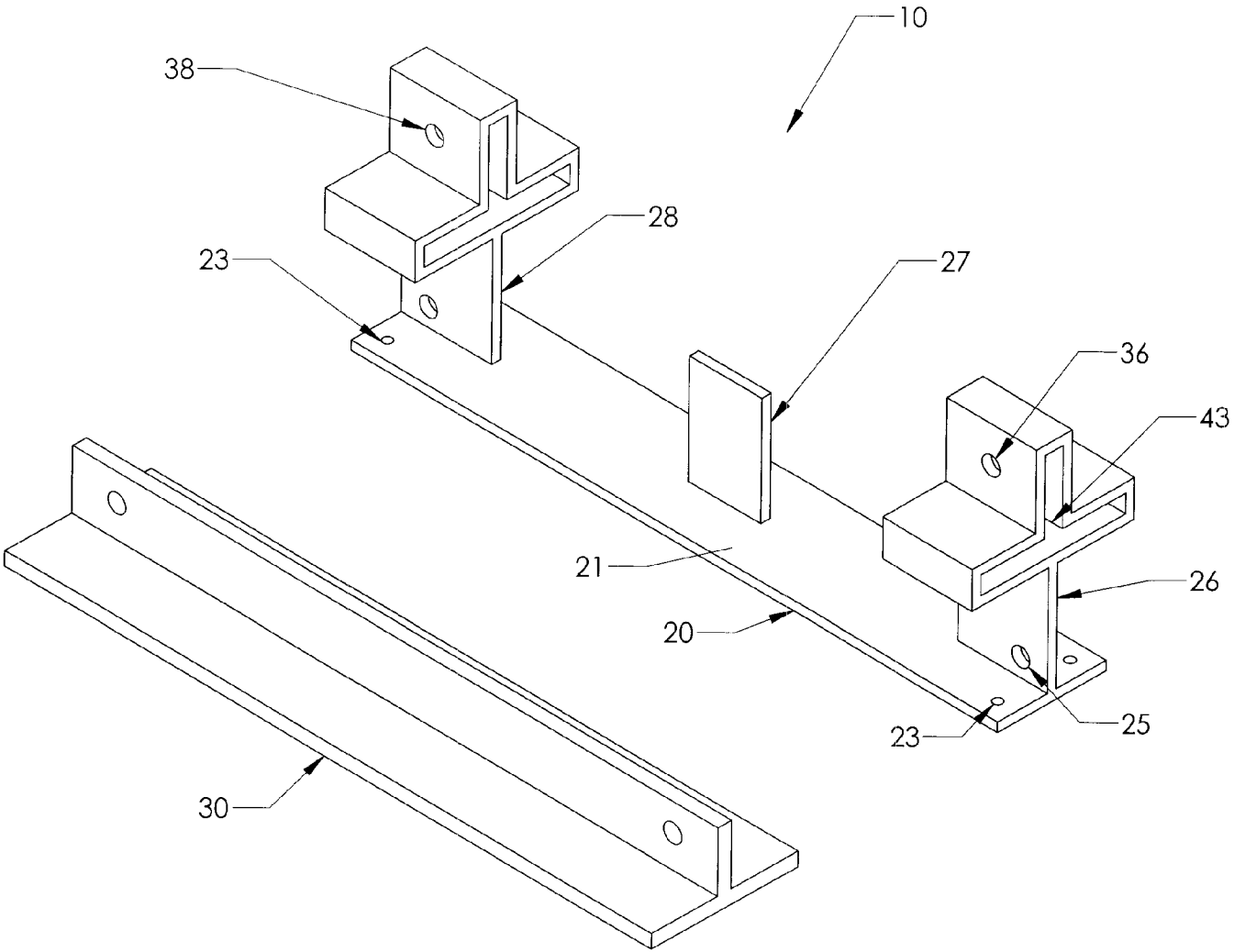
FIG. 8 is substantially an upper perspective, of an embodiment with a bracket that may be slidably attached to the base showing one version of the slide-on mechanism with the retaining brackets slidably coupled to protrusions on each of the mounting plates.
Figure 9:
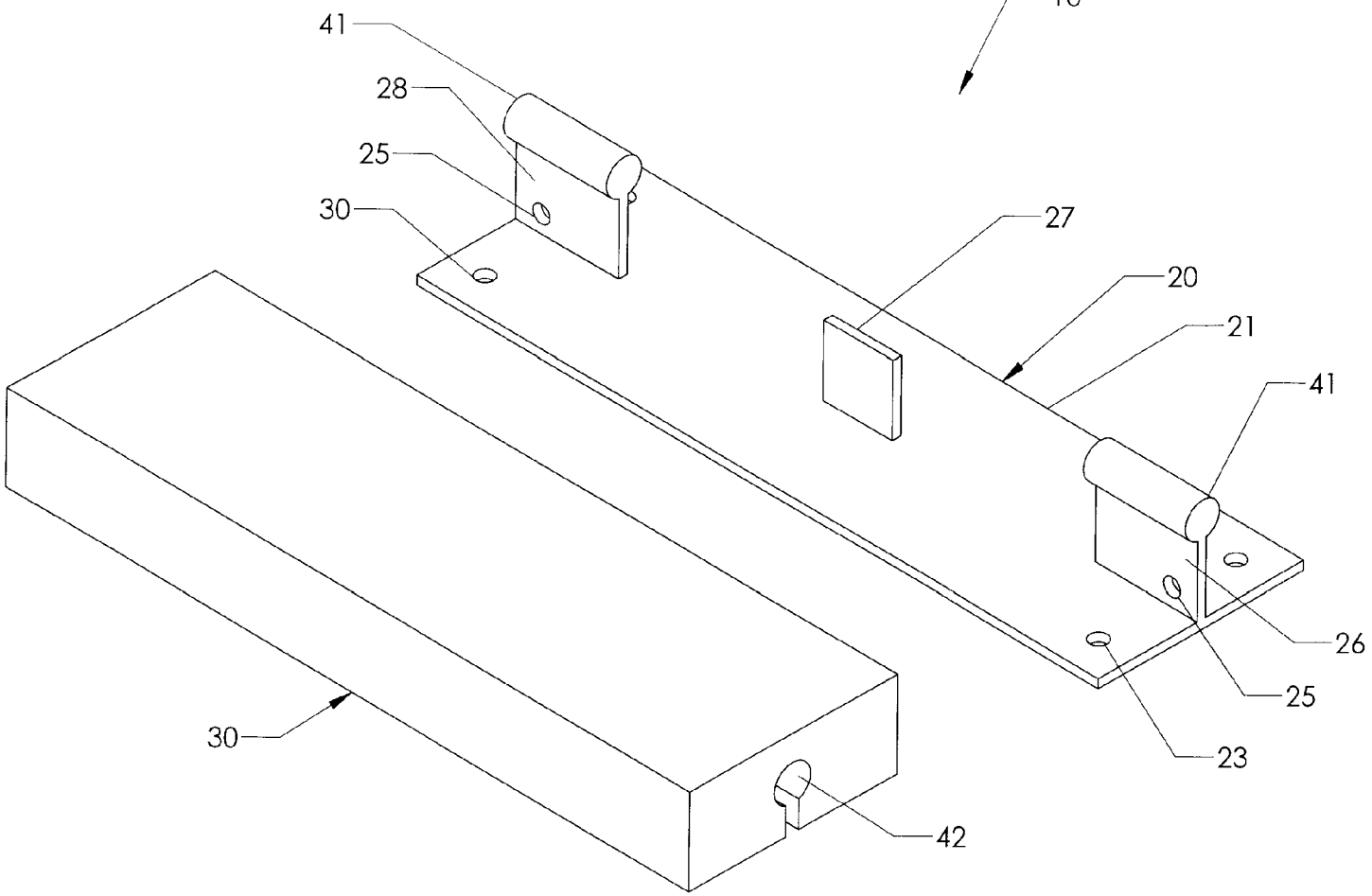
FIG. 9 is substantially an upper perspective showing another version of the slide-on mechanism with the retaining brackets passing through apertures on each of the mounting plates.

In another embodiment of the present invention, illustrated in FIGS. 8 and 9, the retaining brackets 30, 32 brackets are slidably coupled to the mounting plates 26, 28. As used herein, the term "slidably coupled" means that the elements in question are adapted to slide onto and/or off of each other by any means described herein or by any mean known to those of ordinary skill in the art. One of ordinary skill will appreciate numerous ways the retaining brackets 30, 32 may be designed to slide onto and/or off of the mounting plates 26, 28. As in the earlier described embodiments, the retaining brackets and mounting plates may then be fastened into a substantially fixed position through the use of at least one retaining pin 40 extending through apertures in the retaining brackets 36, 38 and apertures in the mounting plate 29. The retaining brackets 30, 32 may also be fastened to the mounting plates 26, 28 by at least one bolt or by numerous other means known to those of ordinary skill in the art. The following are a few examples of how the retaining brackets may be slidably coupled to the mounting plates, not intended to limit the scope of this embodiment of the present invention in any way.

In one example means by which the mounting plates 26, 28 and retaining brackets 30, 32 may be slidably coupled to each other, the retaining bracket may have at least one receiving channel 42, and the first mounting plate may have at least one protrusion 41 adapted to slide into and/ or out of the receiving channel 42 located on the retaining bracket. This way of slidably coupling the retaining brackets to the mounting plates is shown in FIG. 9. These elements may also be reversed, with the retaining bracket 30, 32 having at least one protrusion 41 and the mounting plate 26, 28 having at least one receiving channel 42. With either version, the element on the mounting plate 26, 28 (whether the protrusion 41 or receiving channel 42) is preferably located on or near the top end of the mounting plate 26, 28. The element on the retaining bracket 30, 32 (whether the protrusion 41 or receiving channel 42) is preferably located on or near the underside of the retaining bracket 30, 32. The protrusion 41 may be of variable size, shape, and material composition. The protrusion 41 may or may not be made of the same type of material as the rest of the mounting plate or retaining bracket. The protrusion 41 may comprise a substantially cylindrically shaped bead (as shown in FIG. 9), a substantially polygonal shaped member, or have another suitable shape. The receiving channel 42 may also be of variable size, length, shape, and material composition. The receiving channel 42 may be substantially straight. The receiving channel 42 is preferably shaped and sized such that the protrusion 41 fits fairly snugly inside the receiving channel 42 such that the only way to remove the protrusion 41 from the channel is to slide it out one of the ends of the channel. The receiving channel 42 may also be closed at one end, thereby limiting ingress and egress by the protrusion 41 to the one open end of the channel. The receiving channel 42 may have a key-hole like shape complimentary to a spherical bead as shown in FIG. 9. Preferably also, the receiving channel 42 and the protrusion 41 fit together so as to allow the two elements to slide against one another in the direction of the channel but in no other direction.

Figure 10:
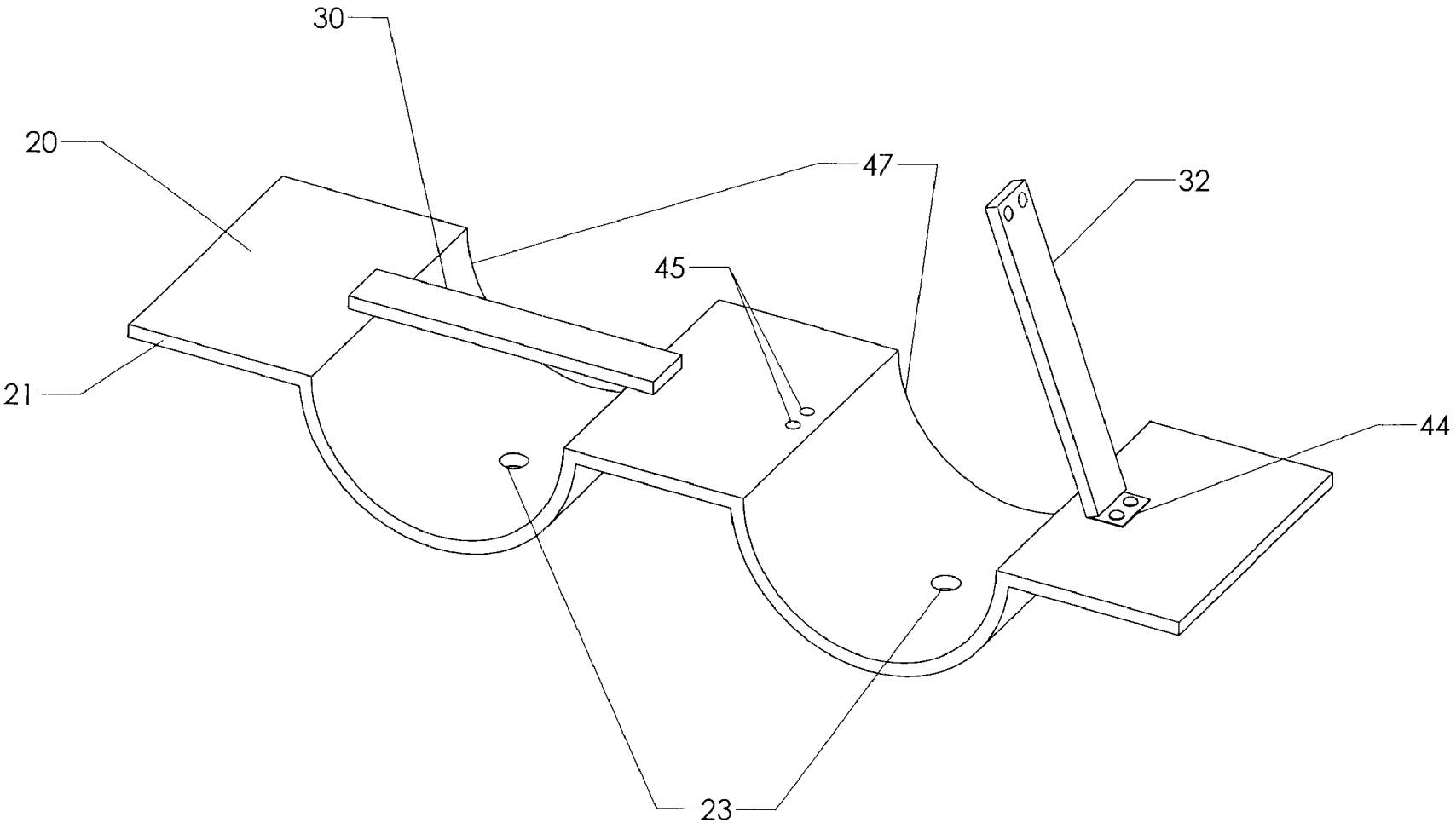
FIG. 10 is substantially an upper perspective showing the hose channel mechanism.

FIG. 8 illustrates another example means by which the mounting plates 26, 28 and retaining brackets 30, 32 may be slidably coupled to each other. The mounting plates 26, 28 may contain at least one retaining aperture 43 through which the retaining brackets are slid. FIG. 10(*a*) shows this design before the retaining bracket has been passed through the retaining aperture 43 in the mounting plate. The retaining aperture 43 on the mounting plate 26, 28 is preferably shaped and sized such that the retaining bracket 30, 32 itself fits fairly snugly inside the retaining aperture 43. This way, the bracket may be efficiently slid into position and removed. In accordance with this example design, the retaining brackets 30, 32 preferably will slide through the mounting plates in a substantially perpendicular manner. To accommodate for this the mounting plates 26, 28 are preferably configured to be substantially perpendicular to a centerline extending from the first end 22 to the second end 24 of the base plate 21 and located at the second end 24 of the base plate 21. Once slid into position, the retaining brackets 30, 32 may be fastened into a substantially fixed position by passing at least one retaining pin 40 through apertures in the retaining brackets 36, 38 and apertures through the mounting plates 29. Other fastening methods known to those of ordinary skill in the art may also be used to fasten the retaining brackets 30, 32 into a substantially fixed position. Also, as illustrated by FIG. 8, the aperture 43 on mounting plates 26, 28 may have a hollow inverted T-shape. In accordance with this example design, the retaining brackets 30, 32 will also have an inverted T-shape and be sized to fit snugly in the inverted T-shaped aperture of the mounting plates 26, 28.

G. Method of Retaining a Hose

In still another embodiment of the present invention, a method of retaining a hose is provided. The method comprises: placing a hose 12 onto a base member 20, the base member 20 having a base plate 21, a first mounting plate 26 and a second mounting plate 28, the first mounting plate 26 being slidably coupled to at least one retaining bracket; sliding the retaining bracket over the hose along the first mounting plate 26, thereby securing the retaining bracket base member 20. Optionally, the method provided may further comprise pressure testing the hose 12. The method may also further comprise: sliding the retaining bracket 30, 32 off of the first mounting plate 26; and removing the hose 12 from the base member 20. In accordance with this embodiment, the base member 20 and retaining bracket 30, 32 may in combination control movement of the hose 12 during pressure testing.

H. Hose Channel Embodiment

FIG. 10 illustrates another embodiment of the present invention. In this embodiment, the base member has a base plate 21, the base plate having at least one hose channel 47 with at least one retaining bracket 30, 32 coupled to each hose channel 47. In accordance with this embodiment, the retaining brackets may be coupled directly to the hose channels 47 of the base plate 21. Alternatively, the base member 20 may further include a first mounting plate 26, a second mounting plate 28, and a center plate 27. In such a case the retaining brackets 30, 32 are coupled to the mounting plates through means discussed elsewhere herein. This design may provide a separate closure mechanism for each hose channel 47. A "hose channel" as used herein, means a channel sized and shaped so that it is capable of securing at least one hose 12. The hose channel 47 may vary widely in terms of width, depth, length, and shape in order to accommodate hoses of different sizes. An advantage of this embodiment is that when two or more hoses are being pressure tested or otherwise used, one or more hoses may be removed while others are still being pressure tested or otherwise used. This is accomplished through the coupling of at least one retaining bracket to each hose channel 47. The hose may be secured inside of the hose channel 47 by fastening the retaining bracket in a substantially fixed position over the hose channel 47. The retaining brackets 30, 32 may be fastened over the hose channel 47 with one or more pins, bolts, hinges, or a combination thereof.

Optionally, the retaining bracket 30, 32 may be coupled with the hose channel 47 in the following way. The retaining bracket 30, 32 may be connected to a hinge 44 located on one side of the hose channel 47, with the hinge 44 being configured to allow the retaining bracket 30, 32 to pivot to and from a position lying across the top of the hose channel 47. The retaining bracket 30, 32 may then be fastened to and released from the side of the hose channel 47 not attached to the hinge 44. The foregoing optional design is illustrated on the right side of FIG. 10. Optionally also, the retaining bracket 30, 32 may be slidably coupled to the hose channel 47 in a manner similar to the slide on embodiment presented earlier. In accordance with this option, the retaining bracket 30, 32 may have at least one receiving channel 42, the base plate 21 may have at least one protrusion 41 adapted to slide into and/or out of the receiving channel 42 located on the retaining bracket. Preferably, the protrusion 41 would be located on or near the edge of the hose channel 47. These elements may also be reversed, with the retaining bracket 30, 32 having at least one protrusion 41 and the base plate 21 having at least one receiving channel 42.

In accordance with another embodiment of the invention is a method of retaining at least one hose 12 comprising: placing a hose 12 onto a base member 20 having a base plate 21, the base plate 21 having at least one hose channel 47 coupled to at least one retaining bracket 30, 32; placing the retaining bracket 30, 32 over the hose 12; securing the retaining bracket to the base plate 21 such that the hose is secured between the retaining bracket 30, 32 and the hose channel 47. Optionally, the method provided may further comprise pressure testing the hose 12. The method may also further comprise: releasing the retaining bracket 30, 32 from the base plate 21 on at least one side of the hose channel 47; pivoting the retaining bracket away from the hose or sliding the bracket off of the base member 20; and removing the hose 12 from the base member. In accordance with this embodiment, the base member 20 and retaining bracket 30, 32 may in combination control movement of the hose 12 during pressure testing.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

What is claimed is:

1. A hose anchor and securement system comprising:

(A) a base member having a base plate, a first mounting plate at a first end of the base plate and a second mounting plate at a second end of the base plate opposite the first end, each of the first mounting plate and the second mounting comprising a first slidable coupling; and (B) at least one retaining bracket comprising a second slidable coupling complementary to the first slidable coupling, the at least one retaining bracket slidably coupled to the first mounting plate and the second mounting plate and extending between the first mounting plate and the second plate, wherein the retaining bracket slides in a direction from one of the first mounting plate or the second plate to the other of the first mounting plate or the second mounting plate and wherein a space is provided between the base plate and the retaining bracket, the space being configured to receive a hose.

2. The hose anchor and securement system of claim 1, wherein the retaining bracket has at least one receiving channel; and the first mounting plate and the second mounting plate each have at least one protrusion adapted to slide into the receiving channel.

3. The hose anchor and securement system of claim 1, wherein the first mounting plate and the second mounting plate each have at least one receiving channel and the retaining bracket has at least one protrusion adapted to slide into the receiving channel.

4. The hose anchor and securement system of claim 1, wherein the first mounting plate and the second mounting plate each have at least one retaining aperture; and the retaining bracket is adapted to slide into the aperture.

5. The hose anchor and securement system of claim 4, wherein the retaining aperture comprises an inverted T-shape.

6. The hose anchor and securement system of claim 1, further comprising a first retaining bracket and a second retaining bracket slidably coupled to the first and second mounting plates.

7. The hose anchor and securement system of claim 1, wherein the first mounting plate and the second mounting plate are substantially perpendicular to the base plate.

8. The hose anchor and securement system of claim 1, wherein the base plate has at least one anchor aperture.

9. The hose anchor and securement system of claim 1, wherein the retaining bracket includes a base and a wall.

10. The hose anchor and securement system of claim 1, wherein the retaining bracket is substantially L-shaped.

11. The hose anchor and securement system of claim 1, wherein a first retaining pin extends through a first aperture in the retaining bracket.

* * * * *